US011626230B2

(12) United States Patent
Zhang et al.

(10) Patent No.: US 11,626,230 B2
(45) Date of Patent: Apr. 11, 2023

(54) PERMANENT MAGNET STRUCTURE-BASED PIPELINE DEMAGNETIZATION DEVICE AND APPLICATION THEREOF

(71) Applicant: Shanghai Jieling Magnetic Material & Devices Co., Ltd., Shanghai (CN)

(72) Inventors: Huixin Zhang, Shanghai (CN); Shiyuan Zhang, Shanghai (CN); Xiaoqing Wang, Shanghai (CN)

(73) Assignee: Shanghai Jieling Magnetic Material & Devices Co., Ltd., Shanghai (CN)

( * ) Notice: Subject to any disclaimer, the term of this patent is extended or adjusted under 35 U.S.C. 154(b) by 365 days.

(21) Appl. No.: 16/649,141

(22) PCT Filed: Nov. 6, 2017

(86) PCT No.: PCT/CN2017/109523
§ 371 (c)(1),
(2) Date: Mar. 20, 2020

(87) PCT Pub. No.: WO2019/056514
PCT Pub. Date: Mar. 28, 2019

(65) Prior Publication Data

US 2020/0294699 A1 Sep. 17, 2020

(30) Foreign Application Priority Data

Sep. 22, 2017 (CN) ..... 201710865100.4

(51) Int. Cl.
*H01F 13/00* (2006.01)
*H01F 7/02* (2006.01)

(52) U.S. Cl.
CPC ..... *H01F 13/006* (2013.01); *H01F 7/021* (2013.01); *H01F 7/0221* (2013.01)

(58) Field of Classification Search
CPC ..... H01F 13/00–13/006; F16L 55/26–55/48
See application file for complete search history.

(56) References Cited

FOREIGN PATENT DOCUMENTS

| | | |
|---|---|---|
| CN | 101651006 | 2/2010 |
| CN | 201503743 | 6/2010 |

(Continued)

OTHER PUBLICATIONS

"International Search Report (Form PCT/ISA/210) of PCT/CN2017/109523", dated Jun. 21, 2018, with English translation thereof, pp. 1-5.

*Primary Examiner* — Ramon M Barrera
(74) *Attorney, Agent, or Firm* — JCIP Global Inc.

(57) ABSTRACT

A pipeline demagnetization device based on a permanent magnet structure includes a central piece and permanent magnets distributed on the central piece. A magnetic field with alternating directions is formed in a wall of a pipeline in an axial direction from front to back, and strength of the magnetic field gradually decreases. The pipeline demagnetization device can be applied to the pipeline demagnetization using a built-in structure or an externally-built structure. The pipeline demagnetization device spatially constructs a set of stable alternately-decayed magnetic fields, so that the wall of the pipeline experiences the set of alternately-decayed magnetic fields when the pipeline that is magnetized spatially displaces relative to the set of alternately-decayed magnetic fields, thereby realizing demagnetization.

11 Claims, 5 Drawing Sheets

(56) References Cited

FOREIGN PATENT DOCUMENTS

| | | |
|---|---|---|
| CN | 102866367 | 1/2013 |
| CN | 102881401 | 1/2013 |
| EP | 2974820 | 1/2016 |
| JP | 2013089734 | 5/2013 |
| RU | 2285254 | 10/2006 |
| RU | 117186 U1 * | 6/2012 |

* cited by examiner

PERMANENT MAGNET STRUCTURE-BASED PIPELINE DEMAGNETIZATION DEVICE AND APPLICATION THEREOF

CROSS-REFERENCE TO RELATED APPLICATION

This application is a 371 of international application of PCT application serial no. PCT/CN2017/109523, filed on Nov. 6, 2017, which claims the priority benefit of China application no. 201710865100.4, filed on Sep. 22, 2017. The entirety of each of the above mentioned patent applications is hereby incorporated by reference herein and made a part of this specification.

BACKGROUND

Technical Field

The disclosure relates to a demagnetization device, in particular, to a pipeline demagnetization device based on the permanent magnet structure and an application thereof.

Description of Related Art

With the development of energy such as petroleum and natural gas and chemical industries, the transportation pipelines have been widely deployed around the world, and the total length of pipelines with various calibers is difficult to calculate. Due to the interaction between the transportation object and the surrounding environment and destructions caused by human factors such as war, these pipelines will experience corrosion and thinning, perforation and breakage, etc., which cause a leak or even an explosion.

In-pipe inspection technology can introduce equipment with detection devices in the pipeline without affecting the normal operation of the pipeline, so as to effectively detect metal defects such as deformation and corrosion in the pipeline, and perform accurate positioning, thereby providing scientific maintenance basis for safe operation of pipelines. Magnetic Flux Leakage (MFL) is an effective internal detection technology that can effectively check the health status of natural gas and oil pipelines with different calibers.

When the pipeline magnetic leakage detection equipment is introduced into the pipeline, the equipment moves along the line under the pressure inside the pipeline. The detection equipment itself carries a section of magnetic joints, which can saturate and magnetize the wall passing through, and form a magnetic circuit with the wall. If the wall of the pipeline has defects, the magnetic field lines in the wall will be redistributed around the defects, and a part of the magnetic field lines will leak out into the surrounding medium. The leaked magnetic field is detected by the Hall probe located between the magnetic poles and densely placed in the circumferential direction close to the wall. These signals are recorded in the memory after being filtered, amplified, and converted, and are judged and identified after being processed by the data analysis system when the detection is completed, so as to detect the corrosion of the pipelines.

The pipeline magnetic flux leakage detection technology will create a new problem: oil and gas pipelines are saturated magnetized during the detection, and the residual magnets remain in the matrix of the pipeline without being eliminated. Pipelines produced by different processes and different grades of materials will have different magnetic performance characteristic parameters and different sizes of residual magnets.

Leaving magnetism inside the pipelines has following problems.

1) The pipelines with residual magnetism will affect the accuracy of subsequent magnetic flux leakage detection.

2) An adverse effect will occur upon maintenance and welding of pipelines. Pipeline repairing often requires the use of electric welding technology, but the welding of pipelines with residual magnetism will produce deflection arcs and flashovers, which will greatly affect the welding quality.

So, how to demagnetize the pipeline has created a new technical topic.

In order to eliminate the effects of this residual magnetism on the later maintenance and welding, people can only employ local demagnetization after the pipeline is cut. For example, a cable is wound around the welding part, so that the magnetic field generated by the energized cable is used to cancel the original residual magnetism. However, since the pipeline has been saturatedly magnetized entirely, the magnetism will continue to be transmitted from the distant position even if the winding method is used to locally demagnetize, making it difficult to achieve the desired effect. And the grades of pipelines are different, so their residual magnetism is different. Therefore, for the situation where there has severe magnetization, the magnetic field strength in the slit is even above 2000 Gs, which further increases the difficulty of demagnetization and cannot form an effective standard operation. The American Petroleum Institute (API) has explained and stipulated the residual magnetism in oil pipelines after electromagnetic detection, recommending that the residual magnetism of pipelines after detection should be less than 30 Gs.

Currently, conventional demagnetization methods include high-temperature demagnetization, coil demagnetization, and ground demagnetization. For high-temperature demagnetization, the ferromagnetic workpiece has to be heated above the Curie point, so that it can be demagnetized by cooling in an environment without an external magnetic field. However, due to project implementation, cost and other reasons, its application in engineering practice has been limited. For coil demagnetization, the demagnetization is performed by winding a coil around a pipeline while applying an alternating current. For ground demagnetization, the magnetically permeable material is placed at the joints of pipelines, and the magnetic field lines can penetrate the magnetically permeable material as much as possible since the magnetically permeable material is equivalent to providing a short-circuit path, so that the magnetic field strength at the welding part is reduced to achieve the purpose of welding. This method is commonly known as the ground method. However, the above methods cannot demagnetize the entire pipelines, and these methods are all temporarily demagnetization methods during the maintenance of the pipelines, so that both the progress of project maintenance and the quality of project implementation are affected. Therefore, the market urgently requires a method for on-line demagnetization of the pipelines, which can achieve the purpose of demagnetization after the pipeline detection is completed, and also a new technology and new equipment are required.

Chinese patent CN1002866367A discloses a demagnetization detection device and a demagnetization detection method thereof. The demagnetization detection device is used to be electrically connected to a power control unit of a permanent magnet motor to be detected, and the power control unit is electrically connected to a DC power source. The demagnetization detection device senses a voltage value to be detected and a current value to be measured of the DC power source, and calculates a power value to be detected of the DC power source according to the voltage value to be detected and the current value to be detected. The demagnetization detection device determines a difference between the power value to be detected and a standard power value, and determines whether the permanent magnet motor to be detected is in a demagnetized state according to the difference. However, the device utilizes an electromagnet for demagnetization, which cannot be applied in long-distance transportation pipelines.

SUMMARY

The disclosure aims at solving shortcomings in the prior art, and providing a pipeline demagnetization device based on the permanent magnet structure that spatially achieves alternately-decayed magnetic fields The purpose of the present may realize by following technical solutions.

A pipeline demagnetization device based on a permanent magnet structure, consisting of a central piece and permanent magnets distributed on the central piece. A magnetic field with alternating directions is formed in a wall of a pipeline in an axial direction from front to back, and strength of the magnetic field gradually decreases.

The permanent magnets are single ring magnets or series structures composed of double ring magnets.

The single ring magnet is a radially-magnetized ring magnet, which is an entire radially-magnetized magnetic ring or is formed by splicing a plurality of magnetic steel.

The single ring magnets are placed at intervals along an axial direction of the central piece, and magnetization directions are alternately reversed one by one. Sizes of the single ring magnets arranged along the axial direction of the central piece are gradually reduced, such as diameter or thickness of the magnets. Magnetic performances of the single ring magnets are gradually decreased. The strength of the magnetic field formed by the magnets in the pipeline is gradually decayed with a decaying magnitude of 1 to 99%.

Preferably, the decaying magnitude is 10-50% to achieve the alternating magnetic fields that gradually decay in the axial direction.

The series structures composed of the double ring magnet are series groups formed by two radially-magnetized ring magnets with opposite magnetization directions.

The ring magnets are entire radially-magnetized magnetic rings or are formed by splicing a plurality of magnetic steel. Grouping double ring magnets in series has advantages of adjusting the magnetic field strength of each waveform step by step to achieve precise control on demagnetization.

The series structures composed of the double ring magnets are placed at intervals along the axial direction of the central piece, magnetization directions between the two ring magnets in each of the series structures are opposite, and in two adjacent series structures, magnetization directions between the adjacent ring magnets are same. The magnetic performances and sizes of the two ring magnets forming the series structure are same. The magnetic performances of each series structures are gradually decreased, such as diameter or thickness of the magnets are gradually decreased, and a decaying magnitude of the strength of the magnetic field formed in the wall of the pipeline is 1 to 99%.

Preferably, the decaying magnitude is 10-50% to achieve the alternating magnetic fields that gradually decay in the axial direction.

The central piece is a magnetically permeable member or a non-magnetically permeable member, including solid or hollow iron core, aluminum core or copper core, and stainless steel core. The central piece may be a magnetically permeable material to form a magnetic circuit, and also may be a partially non-magnetically permeable material. The selected materials are mainly for the purpose of forming a suitable magnetic circuit. For the application of the pipeline demagnetization device based on the permanent magnet structure, the device has a built-in structure for demagnetization inside a long pipeline, and is pulled forward by a pressure in the pipeline, so that the pipeline that is magnetized experiences a process of alternatively decaying magnetic fields to realize demagnetization.

When performing magnetic filtering or magnetic flux leakage detection on long-distance natural gas and oil pipelines, a magnetic filter or a magnetic flux leakage detector is under the pressure of the pipeline, and the equipment will move forward along the pipeline. A strong magnet is mounted on the magnetic filter or the magnetic flux leakage detector, so that wherever the equipment goes, the pipeline wall will be saturatedly magnetized, so that the entire long-distance transportation pipeline is severely magnetized.

For long-distance natural gas and oil pipelines, the demagnetization device has a built-in structure. The demagnetization device may be a single set of device, which is pulled forward by a pressure in the pipeline such that each position of the pipeline experiences a process of alternatively decaying magnetic fields to realize demagnetization. The demagnetization device may also be used as an accessory device, which may be hung on a rear end of the magnetic filter or magnetic flux leakage detector such that the demagnetization operation for the pipelines is completed while performing the traditional filtering or magnetic leakage detection operations.

The device is provided in one or plurality, and is directly arranged in the pipeline or connected to a rear end of a magnetic filter or a rear end of a magnetic flux leakage detector. Strength of a magnetic field formed by the permanent magnet arranged at a forefront of the demagnetization device is greater than a coercive force of the pipeline.

When the plurality of the demagnetization devices are provided, the strength of the magnetic field formed in the wall of the pipeline gradually decreases from front to back, and for pipelines with different wall thicknesses and materials, the number of waveforms and the decaying magnitude of the required alternating magnetic field are also different. When a large number of waveforms are required, several demagnetization joints may be connected in series to complete operations if one demagnetization joint is not enough to realize these waveforms. Theoretically, the larger the number of the waveforms of the alternating magnetic fields and the smaller the decaying magnitude, the better the demagnetization effect. Actually, in the design, a suitable number of waveforms and decay ranges are selected in consideration of manufacturing costs and engineering feasibility.

The pipeline demagnetization device is further provided with a support piece that holds it at a center of the pipeline, and that is fixed on the central piece. The support piece may be a magnetically permeable material, such as a magnetically permeable steel brush, which, while serving as a support, may also be used as part of the magnetic circuit, or may be a non-magnetically permeable material, such as non-magnetic stainless steel brush, polyurethane, roller or cup leather, etc., which only serves as a support piece. Also, locally, no support structure is required. The selected materials are mainly for the purpose of forming a suitable magnetic circuit and serving as the support piece.

For the application of the pipeline demagnetization device based on the permanent magnet structure, the device has an externally-built structure, and each of the permanent magnets is axially magnetized for demagnetization of extrusion-molded fittings, so that the fittings experience a process of alternatively decaying magnetic fields by passing through the demagnetization device to realize demagnetization.

During the process of extrusion molding, the finished extrusion-molded fittings are magnetized by an orientation magnetic field, so the finished fittings will be magnetic. An externally-built demagnetization device may be placed at an end of an extrusion molding equipment or at an exit of the molding die. The demagnetization may be achieved as long as the finished fittings are passed through the demagnetization device.

The extrusion-molded fittings are magnetized by an orienting magnetic field during an extrusion process, and the pipeline demagnetization device is arranged at a rear portion of the orienting magnetic field.

Strength of a magnetic field formed by the permanent magnet arranged at the forefront of the demagnetization device is greater than a coercive force of the molded fittings. The permanent magnet is axially magnetized and the polarity direction is changed alternately. This set of magnets may have the same size and are arranged in a manner that the magnet performance gradually decreases, or may have the same performance and are arranged in a manner that the size decreases from large to small, or may be a combination of shapes and sizes to construct a set of alternately-decayed magnetic fields. Pole sheets are placed in the middle of the magnet. The pole sheet may be a magnetic conductor to draw more magnetic field lines, or may be a non-magnetic conductor, which is also a means of forming a specific strength of the magnetic field.

Some pole sheets may be replaced with magnets that are radially-magnetized, and may also be arranged in a manner that the polarity is alternatively placed, so as to draw more magnetic field lines for forming a stronger magnetic field waveform.

The magnetic materials are divided into soft magnetic materials, hard magnetic materials, semi-hard magnetic materials, etc., but no matter what kind of magnetic material, they have their own B-H magnetic hysteresis loops, where H is the strength of the applied magnetic field, and B is the magnetic induction intensity of the material.

Applying a reverse magnetic field to a material that has been magnetized may demagnetize the material, which may be specifically described as follows.

When the strength of the applied reverse magnetic field is lower than the intrinsic coercive force Hci, the original residual magnetism of the material will decrease but the magnetization direction will not change when the applied magnetic field is withdrawn.

When the strength of the applied reverse magnetic field is equal to the intrinsic coercive force Hci, the original residual magnetism of the material will disappear to zero when the applied magnetic field is withdrawn.

When the strength of the applied reverse magnetic field is slightly greater than the intrinsic coercive force Hci, the magnetization direction of the original residual magnetism of the material will be reversed and the residual magnetism will decrease somewhat when the applied magnetic field is withdrawn.

When the strength of the applied reverse magnetic field is much greater than the intrinsic coercive force Hci, the material may be magnetized saturatedly completely in the opposite direction when the applied magnetic field is withdrawn.

According to the B-H hysteresis loop of magnetic materials, it can be known that when the workpiece is placed in an alternately-decayed magnetic field, the trajectory of the hysteresis loop will become smaller and smaller, and when an amplitude of the alternately-decayed magnetic field gradually decreases to zero, the residual magnetism Br in the pipeline may approach zero.

Through the principle, the workpiece may be effectively demagnetized when a set of magnetic fields with alternating polarity and strength, which refers to as the alternately-decayed magnetic field, is applied to the workpiece. The effect of demagnetization depends on an initial strength and an amount of decay of this set of alternately-decayed magnetic field, which mainly includes two aspects.

A reverse magnetization may be realized and further the demagnetization may be realized only when the initial strength of the alternately-decayed magnetic field.

For the amount of decay of the alternately-decayed magnetic field, the amplitude of decay should not be too large. The demagnetization magnetic field of the previous waveform will form a new intrinsic coercive force parameter Hci', and an amplitude of the demagnetization magnetic field of the latter waveform has to be greater than this Hci' value, so that the reverse magnetization may be realized for the workpiece while decreasing the intensity of the residual magnetism. If the decaying magnitude is too large and the subsequent waveforms are not enough to reverse the magnetization direction, the demagnetization will not be completely performed.

The demagnetization method according to the disclosure is an innovative application based on this basic principle. The demagnetization method is based on the permanent magnet structure to spatially construct a set of stable alternately-decayed magnetic fields, so that the wall of the pipeline experiences the set of alternately-decayed magnetic fields when a magnetized pipeline spatially displaces relative to the set of alternately-decayed magnetic fields, thereby realizing demagnetization. To illustrate the characteristics of this magnetic field in a coordinate map, the horizontal axis is the spatial distance, the vertical axis is the strength of the magnetic field, and the curve is the strength of the magnetic field that forms an alternating decay with the change of spatial displacement, as shown in FIG. 2 and FIG. 4. This method is particularly suitable for on-line demagnetization of existing network pipelines.

Compared with the prior art, the disclosure creatively provides a pipeline demagnetization device based on a permanent magnet structure. This is a kind of alternatively-decayed magnetic field that spatially constructs alternating decay. When the workpiece generates a relative displacement with respect to the alternatively-decayed magnetic field, the workpiece may pass through the alternatively-decayed magnetic field to complete demagnetization. Different from the local demagnetization method by traditional coil winding and supplying current with a power source, the disclosure is based on the permanent magnet structure and does not require a power source, and provides two built-in and externally-built demagnetization devices, thereby easily realizing demagnetization for the entire pipelines and fittings.

It is of great significance in demagnetization for entire gas and oil pipelines after detection. At present, the pipeline inspection equipment and service industries have not proposed such a technology, and the method of temporary demagnetization during pipeline maintenance is generally adopted. By disposing the demagnetization joint provided by the disclosure at the end of the pipeline magnetic flux leakage detection device, the purpose of the magnetic flux leakage detection and the pipeline demagnetization may be realized simultaneously, bringing great convenience for later pipeline maintenance and repair.

For the extrusion process of an anisotropic bonded NdFeB fitting product, since the applied orientation magnetic field will magnetize the product, the disclosure may be arranged at the end of the fitting production equipment, and the fittings may pass through the demagnetization device directly after extrusion molding, thereby achieving the purpose of demagnetization. Since producing the anisotropic bonded NdFeB fitting product by the orientation magnetic field is in the R & D and trial production stage, the demagnetization method has not been proposed in the industry, and the disclosure is also the first innovative one.

DESCRIPTION OF THE EMBODIMENTS

The disclosure will be elaborated hereafter in connection with the specific embodiments. The following embodiments will help those skilled in the art to further understand the disclosure, but do not limit the disclosure in any form. It should be pointed out those of ordinary skill in the art may further make a plurality of variations and improvements without departing from the concept of the disclosure. These all belong to the protection scope of the disclosure.

Embodiment 1

Figure 1:
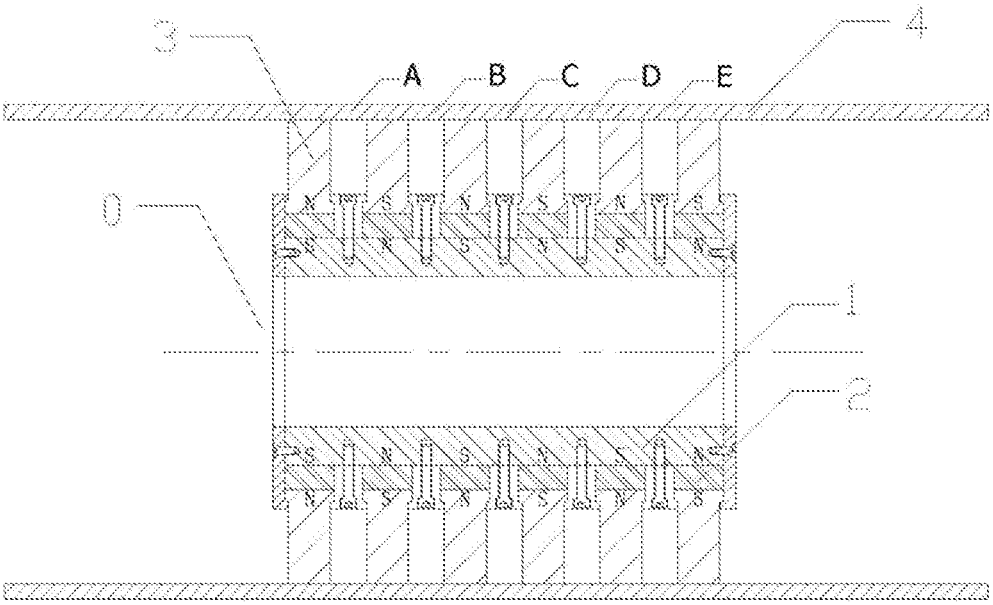
FIG. 1 is a structural diagram of the disclosure in Embodiment 1.

A pipeline demagnetization device based on a permanent magnet structure 0 has a structure shown in FIG. 1, which consists of an iron core 1 and permanent magnets 2 distributed on the iron core 1.

Figure 2:
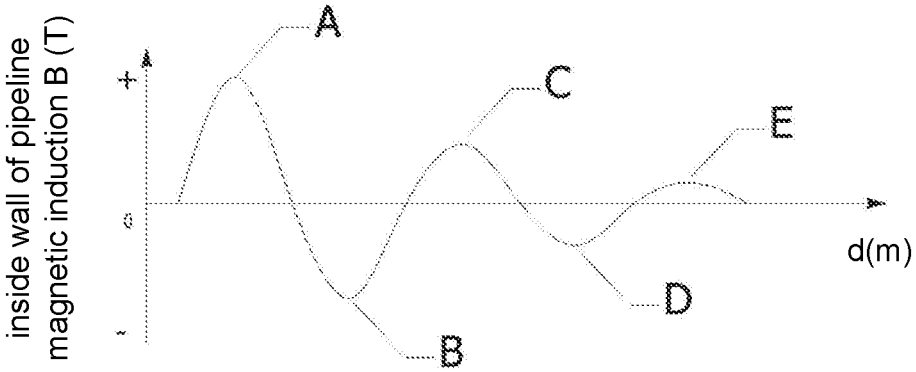
FIG. 2 is a magnetic induction intensity map formed by the disclosure in Embodiment 1.

The iron core 1 may be a magnetically permeable material to form a magnetic circuit, and also may be a partially non-magnetically permeable material. The selected materials are mainly for the purpose of forming a suitable magnetic circuit. Each of the permanent magnets 2 for use is a single ring magnet, which employs a radially-magnetized ring magnet. The ring magnet may be an entire radially-magnetized magnetic ring or is formed by splicing a plurality of magnetic steel. The single ring magnets are placed at intervals along an axial direction of the central piece, and magnetization directions are alternately reversed one by one. Magnetic performances of the single ring magnets arranged along the axial direction of the central piece are gradually decreased, and diameters or thicknesses of the magnets are gradually reduced to form an axially-decayed alternating magnetic field with a decaying magnitude of 1 to 99%. In the present embodiment, the decaying magnitude is 20%, and changes in the intensity of the magnetic induction formed are shown in FIG. 2. A-E in FIG. 1 and FIG. 2 respectively correspond to the position and the strength of the magnetic field at the position.

In addition, in order to facilitate the use of the pipeline demagnetization device 0 in a pipeline 4, the pipeline demagnetization device 0 is further provided with a support piece 3 that holds it at a center of the pipeline, and that is fixed on the iron core 1. The support piece 3 may be a magnetically permeable material, such as a magnetically permeable steel brush, which, while serving as a support, may also be used as part of the magnetic circuit, or may be a non-magnetically permeable material, such as non-magnetic stainless steel brush, polyurethane, roller or cup leather, etc., which only serves as a support piece. Also, locally, no support structure is required. The selected materials are mainly for the purpose of forming a suitable magnetic circuit and serving as the support piece.

Embodiment 2

Figure 3:
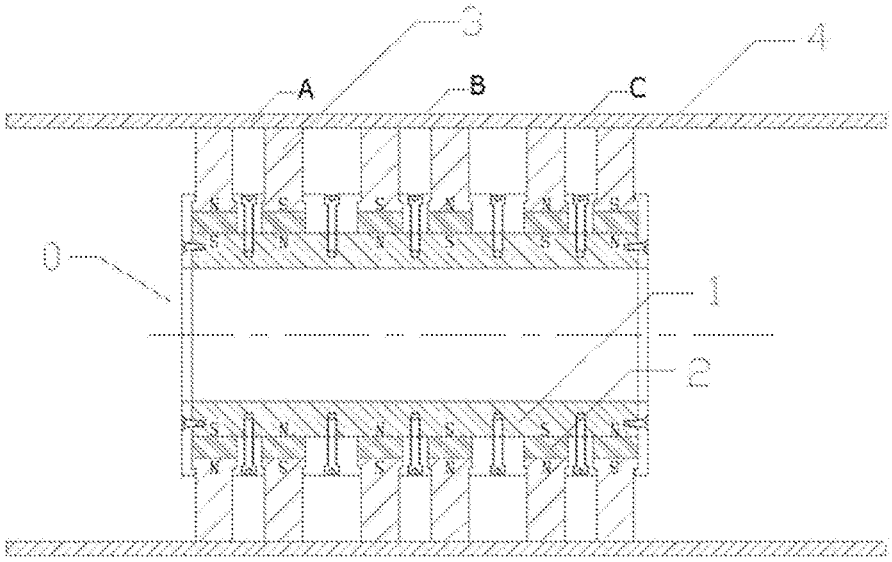
FIG. 3 is a structural diagram of the disclosure in Embodiment 2.
Figure 4:
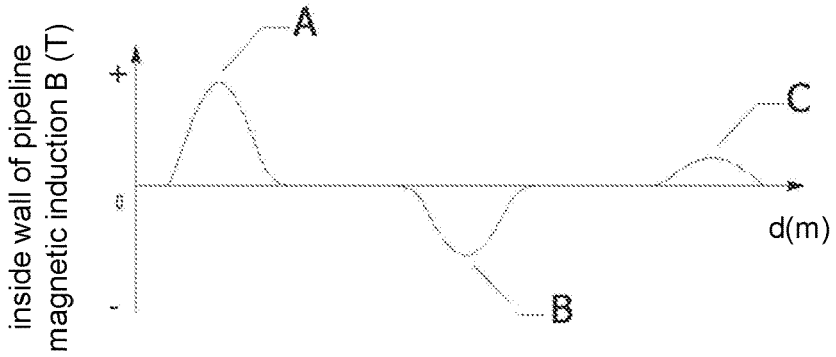
FIG. 4 is a magnetic induction intensity map formed by the disclosure in Embodiment 2.

A pipeline demagnetization device based on the permanent magnet structure 0 has a structure shown in FIG. 3, which consists of the iron core 1 and the permanent magnets 2 distributed on the iron core 1. The structure is the same as that in Embodiment 1, except that the permanent magnet 2 used in the present embodiment is a series structure composed of the double ring magnets, which are two radially-magnetized ring magnets with opposite magnetization directions form a series group. For each set of the double ring magnets, two radially-magnetized ring magnets with opposite magnetization directions form a set. The radial ring magnet may be formed by splicing a plurality of magnetic steel, or may be an entire radially-magnetized magnetic ring. Each set of double ring magnet forms a certain polarity in the wall of the pipeline. A plurality of sets of ring magnets are placed axially at intervals, and the magnetization directions formed in the wall of the pipeline are alternately reversed one by one, forming a magnetic field with alternating polarity in the wall of the pipeline. At the same time, the performance of each set of magnetic rings is reduced one by one, or dimensions such as diameters/thicknesses of the magnetic ring gradually change to realize an alternating magnetic field that gradually decays axially. The series structures composed of the double ring magnets are placed at intervals along the axial direction of the central piece. The magnetization directions between the two ring magnets in the series structure are opposite. In two adjacent series structures, the magnetization directions between the adjacent ring magnets are the same. The magnetic performances and sizes of the two ring magnets forming the series structure are the same. Magnetic performances of the series structures are gradually decreased, such as diameters or thicknesses of the magnets are gradually decreased, and a decaying magnitude of the strength of the magnetic field formed in the wall of the pipeline is 1 to 99%. In the present embodiment, the decaying magnitude is 35%. Grouping double ring magnets in series has advantages of adjusting the strength of the magnetic field of each waveform step by step to achieve precise control on demagnetization, the intensity of the magnetic induction formed are shown in FIG. 4. A-C in FIG. 3 and FIG. 4 respectively correspond to the position and the strength of the magnetic field at the position.

Embodiment 3

For a pipeline demagnetization device based on the permanent magnet structure 0, the device has a built-in structure for demagnetization inside a long pipeline, and is pulled forward by a pressure in the pipeline, so that the pipeline that is magnetized experiences a process of alternatively decaying magnetic fields to realize demagnetization.

When performing magnetic filtering or magnetic flux leakage detection on long-distance natural gas and oil pipelines, the magnetic filter 5 is under the pressure of the pipeline, and the magnetic filter 5 will move forward along the pipeline. A strong magnet is mounted on the magnetic filter 5, so that wherever the magnetic filter 5 goes, the pipeline wall will be saturatedly magnetized, so that the entire long-distance transportation pipeline is severely magnetized.

Figure 5:
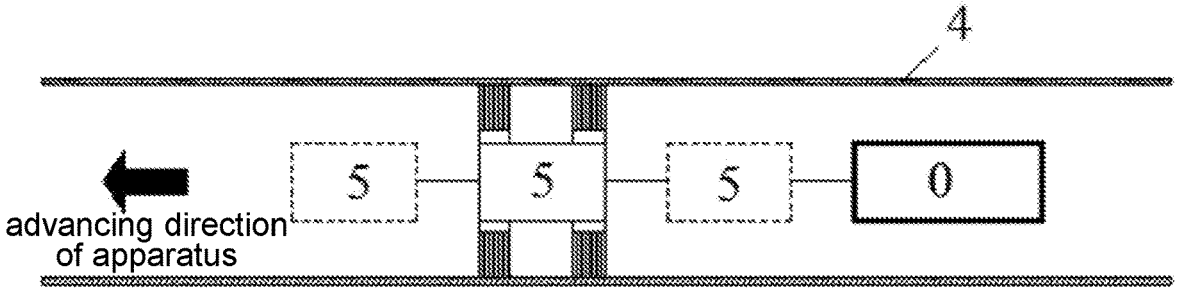
FIG. 5 is a diagram showing an application of the disclosure in Embodiment 3.

For long-distance natural gas and oil pipelines, the pipeline demagnetization device 0 has a built-in structure. The demagnetization device may be a single set of device, which is pulled forward by a pressure in the pipeline such that each position of the pipeline experiences a process of alternatively decaying magnetic fields to realize demagnetization. The demagnetization device may also be used as an accessory device, which may be hung on a rear end of the magnetic filter 5, as shown in FIG. 5, so that the demagnetization operation for the pipelines is completed while performing the traditional filtering or magnetic leakage detection operations. It should be noted that strength of a magnetic field formed by the permanent magnet arranged at the forefront of the demagnetization device is greater than a coercive force of the pipeline.

Embodiment 4

Figure 6:
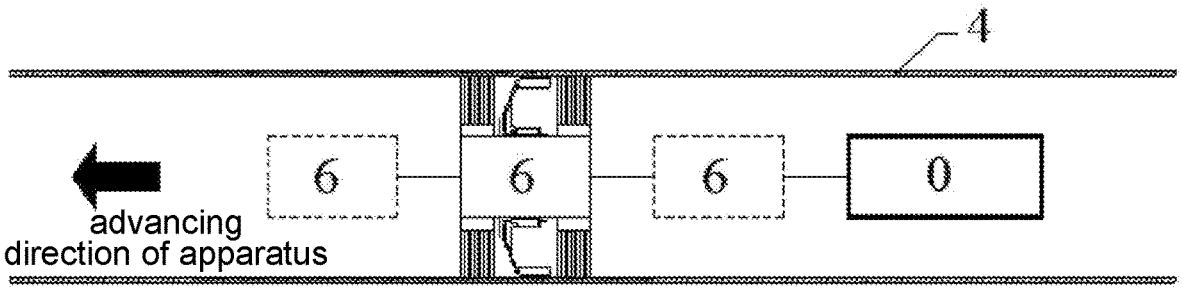
FIG. 6 is a diagram showing an application of the disclosure in Embodiment 4.

For a pipeline demagnetization device based on the permanent magnet structure 0, the device has a built-in structure for demagnetization inside a long pipeline. The structure is the same as that in Embodiment 3, except that in the present embodiment, the pipeline demagnetization device 0 is connected at a rear end of the magnetic flux leakage detector 6, as shown in FIG. 6.

Embodiment 5

Figure 7:
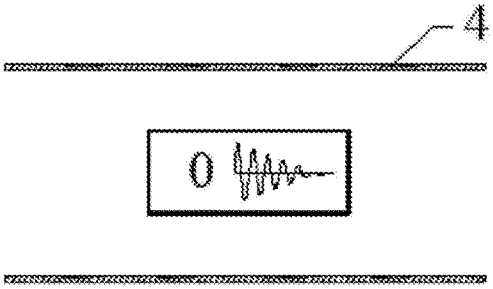
FIG. 7 is a diagram showing an application of the disclosure in Embodiment 5.

For a pipeline demagnetization device based on the permanent magnet structure 0, the device has a built-in structure for demagnetization inside a long pipeline, as shown in FIG. 7. In the present embodiment, one pipeline demagnetization device 0 is arranged for demagnetization.

Embodiment 6

Figure 8:
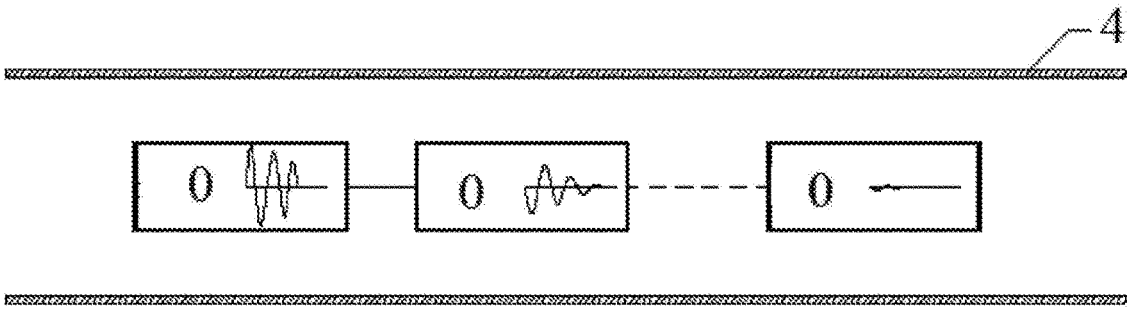
FIG. 8 is a diagram showing an application of the disclosure in Embodiment 6.

For a pipeline demagnetization device based on the permanent magnet structure 0, the device has a built-in structure for demagnetization inside a long pipeline. As shown in FIG. 8, in the present embodiment, a plurality of pipeline demagnetization devices 0 are connected in series for demagnetization. When the plurality of the demagnetization devices are provided, the strength of the magnetic field formed in the wall of the pipeline gradually decreases from front to back, and for pipelines with different wall thicknesses and materials, the number of waveforms and the decaying magnitude of the required alternating magnetic field are also different. When a large number of waveforms are required, several demagnetization joints may be connected in series to complete operations if one demagnetization joint is not enough to realize these waveforms. Theoretically, the larger the number of the waveforms of the alternating magnetic fields and the smaller the decaying magnitude, the better the demagnetization effect. Actually, in the design, a suitable number of waveforms and decaying magnitude are selected in consideration of manufacturing costs and engineering feasibility.

Embodiment 7

Figure 9:
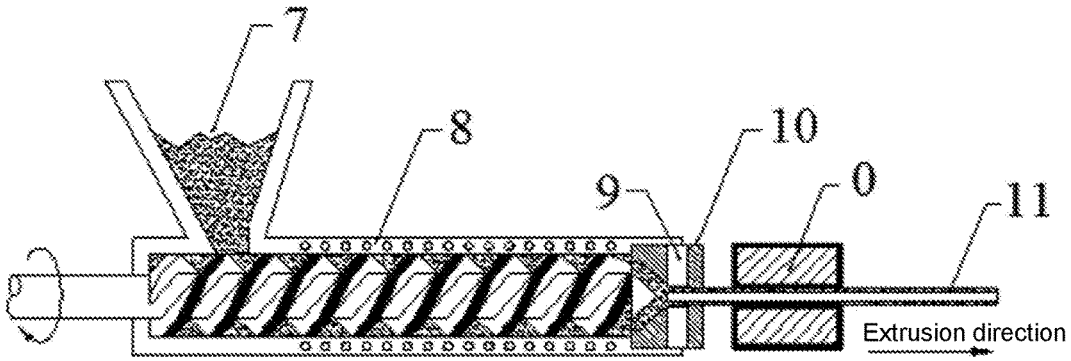
FIG. 9 is a structural diagram of the disclosure used in Embodiment 7.

For the application of the pipeline demagnetization device based on the permanent magnet structure, the device has an externally-built structure. As shown in FIG. 9, an anisotropic bonded NdFeB magnetic powder 7 is heated for extrusion forming through a screw and a heating system 8, a forming mould 10 is provided at a rear end, and an orientation magnetic field 9 is provided inside the forming mould 10. During the process of extrusion molding, since the finished fittings are magnetized by the orientation magnetic field, the finished fittings will be magnetic. An externally-built pipeline demagnetization device 0 may be placed at a rear end of the extrusion molding equipment or at an exit of the molding die. The demagnetization may be achieved as long as the finished fittings 11 are passed through the demagnetization device.

Figure 10:
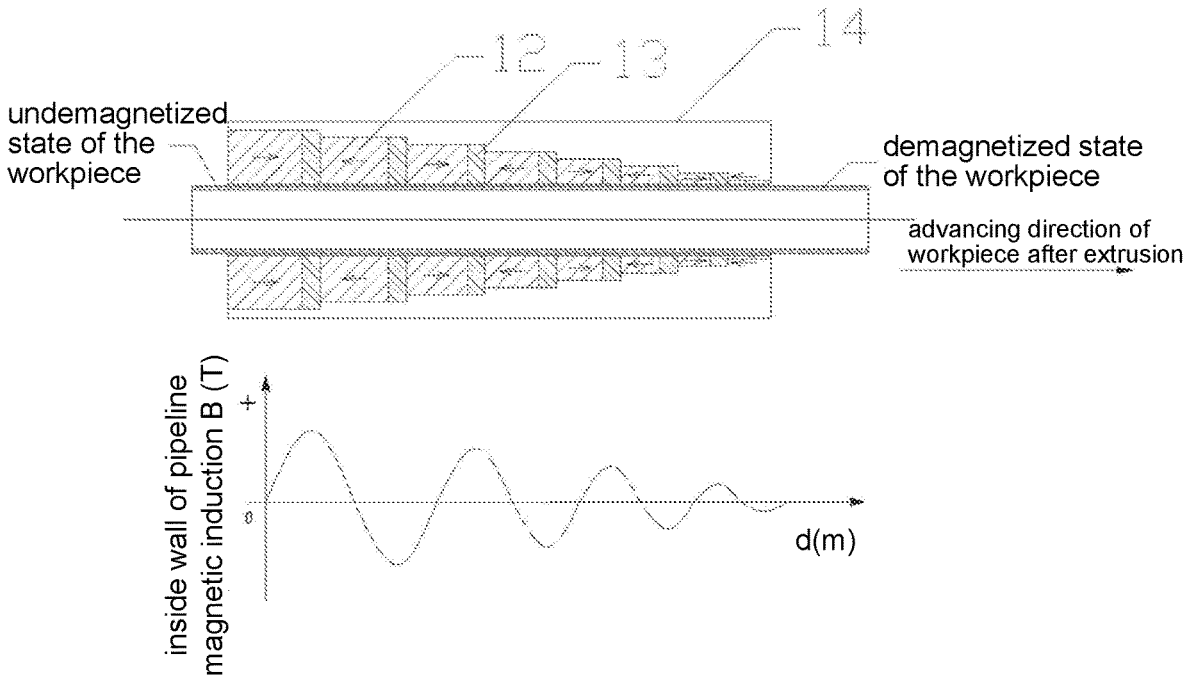
FIG. 10 is a structural diagram of and a magnetic induction intensity map formed by the disclosure in Embodiment 7.

In the present embodiment, the demagnetization device used has a structure shown in FIG. 10, each of the permanent magnets is an axially-magnetized magnet 12, and the polarity direction changes alternatively. The permanent magnets may have the same size and are arranged in a manner that the magnet performance gradually decreases, or may have the same performance and are arranged in a manner that the size decreases from large to small, or may be a combination of shapes and sizes to construct a set of alternately-decayed magnetic fields for demagnetization of the extrusion-molded fittings, so that the fittings experience a process of alternatively decaying magnetic fields by passing through the center of the demagnetization device to realize demagnetization. A pole sheet 13 is placed in the middle of the magnet. The pole sheet 13 may be a magnetic conductor to draw more magnetic field lines, or may be a non-magnetic conductor, which is also a means of forming a specific strength of the magnetic field. The formed magnetic induction intensity is shown in FIG. 10, and the strength of the magnetic field formed by the permanent magnet provided at the foremost end of the demagnetization device is greater than the coercive force of the molded fittings.

Embodiment 8

Figure 11:
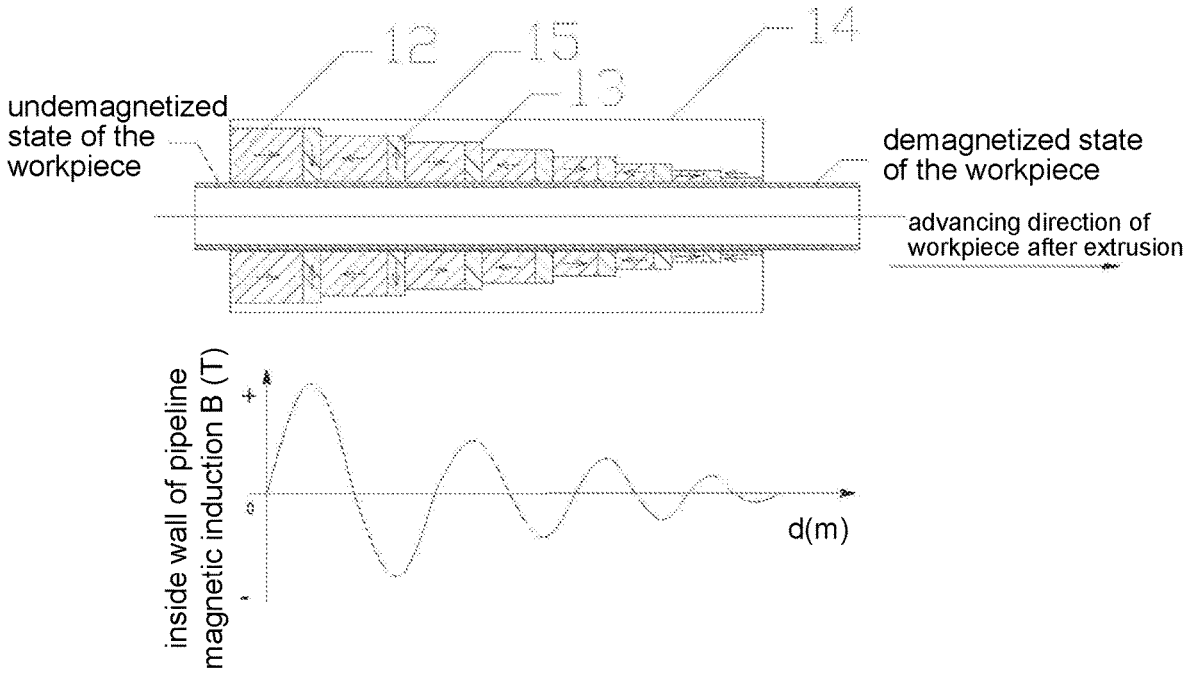
FIG. 11 is a structural diagram of and a magnetic induction intensity map formed by the disclosure in Embodiment 8.

For the application of the pipeline demagnetization device based on the permanent magnet structure, the device has an externally-built structure, and is used in the same way as Embodiment 7. The pipeline demagnetization device has the same structure as that in Embodiment 7, except in that in the present embodiment, some pole sheets 13 may be replaced with magnets 15 that are radially-magnetized, and may also be arranged in a manner that the polarity is alternatively placed, as shown in FIG. 11, so as to draw more magnetic field lines for forming a stronger magnetic field waveform. The formed magnetic induction intensity is shown in FIG. 11.

Embodiment 9

A pipeline demagnetization device based on a permanent magnet structure, consisting of a central piece and permanent magnets distributed on the central piece. A magnetic field with alternating directions is formed in a wall of the pipeline in an axial direction from front to back, and strength of the magnetic field gradually decreases.

The permanent magnet used in the present embodiment is a radially-magnetized ring magnet, and the ring magnet is an entire radially-magnetized magnetic ring. Each ring magnet is placed at intervals along an axial direction of the central piece, and magnetization directions are alternately reversed one by one. Sizes of the single ring magnet arranged along the axial direction of the central piece are gradually reduced, such as diameters or thicknesses of the magnets are gradually reduced, magnetic performances are gradually-decreased, and the strength of the magnetic field formed by the magnet in the pipeline are gradually decayed with a decaying magnitude of 10%. Strength of a magnetic field formed by the permanent magnet arranged at the forefront of the demagnetization device is greater than a coercive force of the pipeline.

The central piece used is a magnetically permeable member or a non-magnetically permeable member, including solid or hollow iron core, aluminum core or copper core, stainless steel core, may be a magnetically permeable material to form a magnetic circuit, and also may be a partially non-magnetically permeable material. The materials selected are mainly for the purpose of forming a suitable magnetic circuit. In the present embodiment, a solid copper core is adopted.

The device may have a built-in structure for demagnetization inside a long pipeline, and is pulled forward by a pressure in the pipeline, so that the pipeline that is magnetized experiences a process of alternatively decaying magnetic fields to realize demagnetization.

When performing magnetic filtering or magnetic flux leakage detection on long-distance natural gas and oil pipelines, the magnetic filter or magnetic flux leakage detector is under the pressure of the pipeline, and the magnetic filter or magnetic flux leakage detector will move forward along the pipeline. A strong magnet may be mounted on the magnetic filter or the magnetic flux leakage detector, so that wherever the magnetic filter or magnetic flux leakage detector goes, the pipeline wall will be saturatedly magnetized, so that the entire long-distance transportation pipeline is severely magnetized.

For long-distance natural gas and oil pipelines, the demagnetization device has a built-in structure. The demagnetization device may be a single set of device, which is pulled forward by a pressure in the pipeline such that each position of the pipeline experiences a process of alternatively decaying magnetic fields to realize demagnetization. The demagnetization device may also be used as an accessory device, which may be hung on a rear end of the magnetic filter or magnetic flux leakage detector such that the demagnetization operation for the pipelines is completed while performing the traditional filtering or magnetic leakage detection operations.

In order to ensure that the demagnetization device is always located at the center of the pipeline so as to ensure the demagnetization effect, a support piece is also fixed on the center piece. The support piece may be a magnetically permeable material, such as a magnetically permeable steel brush, which, while serving as a support, may also be used as part of the magnetic circuit, or may be a non-magnetically permeable material, such as non-magnetic stainless steel brush, polyurethane, roller or cup leather, etc., which only serves as a support piece; also, locally, no support structure is required. The materials selected are mainly for the purpose of forming a suitable magnetic circuit and serving as the support piece. The support piece adopted in the present embodiment is a roller.

Embodiment 10

A pipeline demagnetization device based on a permanent magnet structure has the same structure as Embodiment 9, except in that the permanent magnets used in the present embodiment are radially-magnetized ring magnets formed by splicing a plurality of magnetic steel, and a decaying magnitude for the strength of the magnetic field formed by the magnet in the pipeline is 20%. The center piece used is a hollow aluminum core, and the support for use is a cup leather.

Embodiment 11

A pipeline demagnetization device based on the permanent magnet structure has the same structure as Embodiment 9, except that the permanent magnet used in the present embodiment is a series structure composed of the double ring magnet, which is a series group formed by two radially-magnetized ring magnets with opposite magnetization directions. The ring magnet is an entire radially-magnetized magnetic ring. Employing such series set has advantages of adjusting the strength of the magnetic field of each waveform step by step to achieve precise control on demagnetization. In two adjacent series structures, the magnetization directions between the adjacent ring magnets are the same. The magnetic performances and sizes of the two ring magnets forming the same series structure are the same. Magnetic performances of each series structure are gradually decreased, such as diameters or thicknesses are gradually reduced. A decaying magnitude of the strength of the magnetic field formed in the wall of the pipeline is 5%. In the present embodiment, the support piece may not be adopted.

Embodiment 12

A pipeline demagnetization device based on a permanent magnet structure has the same structure as Embodiment 11, except in that the ring magnets in the present embodiment are formed by splicing a plurality of magnetic steel, and the decaying magnitude is 60%. When the device performs demagnetization, the externally-built structure is adopted, so the support piece is not required. Each of the permanent magnets is axially magnetized for demagnetization of extrusion-molded fittings, so that the fittings experience a process of alternatively decaying magnetic fields by passing through the demagnetization device to realize demagnetization. During the process of extrusion molding, the finished extrusion-molded fittings are magnetized by the orientation magnetic field, so the finished fittings will be magnetic. An externally-built demagnetization device may be placed at the end of the extrusion molding equipment or at the exit of the molding die. The demagnetization may be achieved as long as the finished fittings are passed through the demagnetization device.

The extrusion-molded fittings are magnetized by an orienting magnetic field during an extrusion process, and the pipeline demagnetization device is arranged at a rear portion of the orienting magnetic field. Strength of a magnetic field formed by the permanent magnet arranged at the forefront of the demagnetization device is greater than a coercive force of the molded fittings. The pole sheets may further be provided between the above ring magnets. The pole sheets used are magnetically permeable materials.

The specific embodiments of the disclosure have been described above. It should be understood that the disclosure is not limited to the specific embodiments described above, and those skilled in the art can make various changes or modifications within the scope of the claims, which does not affect the essence of the disclosure.

What is claimed is:

1. A pipeline demagnetization device based on a permanent magnet structure, the pipeline demagnetization device comprising a central piece and permanent magnets distributed on the central piece, wherein a magnetic field with alternating directions is formed in a wall of a pipeline in an axial direction from front to back, and strength of the magnetic field gradually decreases, wherein the permanent magnets are series structures composed of double ring magnets, comprising series groups formed by two radially-magnetized ring magnets with opposite magnetization directions.

2. The pipeline demagnetization device based on the permanent magnet structure according to claim 1, wherein the ring magnets are entire radially-magnetized magnetic rings or are formed by splicing a plurality of magnetic steel.

3. The pipeline demagnetization device based on the permanent magnet structure according to claim 1, wherein the series structures composed of the double ring magnets are placed at intervals along the axial direction of the central piece, magnetization directions between the two ring magnets in each of the series structures are opposite, and in two adjacent series structures, magnetization directions between the adjacent ring magnets are same.

4. The pipeline demagnetization device based on the permanent magnet structure according to claim 1, wherein magnetic performances and sizes of the two ring magnets forming the series structure are same; for each series structure, sizes of the ring magnets are gradually reduced, magnetic performances are gradually decreased, and a decaying magnitude of the strength of the magnetic field formed in the wall of the pipeline are 1 to 99%, preferably 10 to 50%.

5. The pipeline demagnetization device based on the permanent magnet structure according to claim 1, wherein the central piece is a magnetically permeable member or a non-magnetically permeable member, and is a solid piece or a hollow piece.

6. An application of the pipeline demagnetization device based on the permanent magnet structure according to claim 1, wherein the pipeline demagnetization device has a built-in structure for demagnetization inside a long pipeline, and is pulled forward by a pressure in the pipeline, so that the pipeline that is magnetized experiences a process of alternatively decaying magnetic fields to realize demagnetization.

7. The application of the pipeline demagnetization device based on the permanent magnet structure according to claim 6, wherein the pipeline demagnetization device is provided in one or plurality, independently arranged in the pipeline or connected to a rear end of a magnetic filter or a rear end of a magnetic flux leakage detector.

8. The application of the pipeline demagnetization device based on the permanent magnet structure according to claim 7, wherein strength of a magnetic field formed by the permanent magnet arranged at a forefront of the pipeline demagnetization device is greater than a coercive force of the pipeline.

9. The application of the pipeline demagnetization device based on the permanent magnet structure according to claim 7, wherein when the plurality of the pipeline demagnetization devices are arranged, the strength of the magnetic field formed in the wall of the pipeline gradually decreases from front to back.

10. The application of the pipeline demagnetization device based on the permanent magnet structure according to claim 6, wherein the pipeline demagnetization device is provided with a support piece that holds the pipeline demagnetization device at a center of the pipeline, that is fixed on the central piece, and that is a magnetically permeable or non-magnetically permeable member.

11. The pipeline demagnetization device based on the permanent magnet structure according to claim 10, wherein the support piece comprises a steel brush, a roller or a cup leather.

* * * * *